US007017203B2

(12) United States Patent
Chen

(10) Patent No.: US 7,017,203 B2
(45) Date of Patent: Mar. 28, 2006

(54) COT

(75) Inventor: Shun-Min Chen, Taipei Hsien (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 0 days.

(21) Appl. No.: 11/025,042

(22) Filed: Dec. 29, 2004

(65) Prior Publication Data

US 2006/0021134 A1 Feb. 2, 2006

(30) Foreign Application Priority Data

Jul. 27, 2004 (CN) ..... 2004200740012 U

(51) Int. Cl.
*A47D 13/06* (2006.01)
*A47D 7/00* (2006.01)

(52) U.S. Cl. ..... 5/93.1; 5/93.2; 5/98.1

(58) Field of Classification Search ..... 5/93.1, 5/94, 98.1, 93.2

See application file for complete search history.

(56) References Cited

U.S. PATENT DOCUMENTS

| | | | | |
|---|---|---|---|---|
| 2,235,293 | A * | 3/1941 | Mellon | 5/93.1 |
| 2,870,461 | A * | 1/1959 | Rosenthal | 5/93.1 |
| 2,992,440 | A * | 7/1961 | Revolt | 5/93.1 |
| 6,848,128 | B1 * | 2/2005 | Verbovszky et al. | 5/93.1 |

FOREIGN PATENT DOCUMENTS

CA 510623 * 3/1955

* cited by examiner

*Primary Examiner*—Alexander Grosz
(74) *Attorney, Agent, or Firm*—Scully, Scott, Murphy & Presser

(57) ABSTRACT

A cot for a bed pad to be fixed therein is provided. The cot comprises an outer member, a bottom member, and at least one corner member connected to a corner of the bottom member. The outer member and the bottom member are connected and formed as a containing space, and the corner member and the bottom member are connected and formed as a pocket for the bed pad to be inserted and positioned therein.

14 Claims, 5 Drawing Sheets

COT

BACKGROUND OF THE INVENTION

1. Field of the Invention

The present invention relates to a cot.

2. Description of Related Arts

Generally, a conventional cot is rectangular in shape. For the sake of aesthetic, a cot may be designed in an oval shape, but a bed pad must be sized to fit into the cot, and such a bed pad is difficult to be fixed in the cot. A typical bed pad is linked with a cot by using Velcro or buttons, but when the bed pad is off the position, it is easy to cause the bed pad to be disconnected from the cot.

Accordingly, the present invention provides a cot which enable a bed pad to be fixed in the cot having an irregular shape (for example, oval shape) without sizing the bed pad based on the shape of the cot, and in which the bed pad can be easily and quickly fixed in and detached from the cot for facilitating the detached bed pad to be cleaned up.

SUMMARY OF THE INVENTION

To solve the aforementioned problem, a cot according to the present invention has been made. The cot is easy to be positioned and for a bed pad to be detachable from, and provides a storage space.

The object of the present invention is to provide a cot for a bed pad to be fixed therein, comprising an outer member; a bottom member connected to the outer member; and at least one corner member connected to a corner of the bottom member; wherein the outer member and the bottom member are configured as a containing space, and the corner member and the bottom member are configured as a pocket for the bed pad to be inserted and positioned therein.

According to the present invention, the cot further includes an inner member provided in the containing space, wherein the outer member, the inner member and the corner member are configured as a storage space.

In the cot according to the present invention, the outer member has a substantially rectangular cross-section.

In the cot according to the present invention, the inner member has a substantially oval cross-section.

In the cot according to the present invention, the bottom member is substantially rectangular.

In the cot according to the present invention, the corner member is substantially triangular and one side of the corner member is connected to the lower peripheral edge of the inner member.

In the cot according to the present invention, portions of the lower peripheral edge of the inner member corresponding to corners of the outer member are formed with openings thereon for the corners of the bed pad to pass therethrough.

In the cot according to the present invention, the outer member, the inner member, the bottom member and the corner member are made of fabric.

In the cot according to the present invention, the bed pad is a foldable bed pad.

In the cot according to the present invention, the connection is by means of sewing.

In the cot according to the present invention, the corner member contains a hard material therein.

In the cot according to the present invention, the hard material is a plastic material.

In the cot according to the present invention, the cot is detachably suspended in a frame assembly of a playard.

Another object of the present invention is to provide a detachable cot for a playard, comprising an outer member; an inner member; a bottom member connected to the lower peripheral edge of the outer member; at least one corner member connected to a corner of the bottom member; and a foldable bed pad; wherein the outer member and the bottom member are configured as a containing space, and the inner member is provided in the containing space, and wherein the outer member, the inner member and the corner member are configured as a storage space, and the corner member and the bottom member are configured as a pocket for the foldable bed pad to be inserted and positioned therein.

BRIEF DESCRIPTION OF THE DRAWINGS

These and other features, aspects and advantages of the present invention will become more apparent from the following description, appended claims, and accompanying exemplary embodiments shown in the drawings, which are briefly described below.

DETAIL DESCRIPTION OF THE PREFERRED EMBODIMENT

Figure 1:
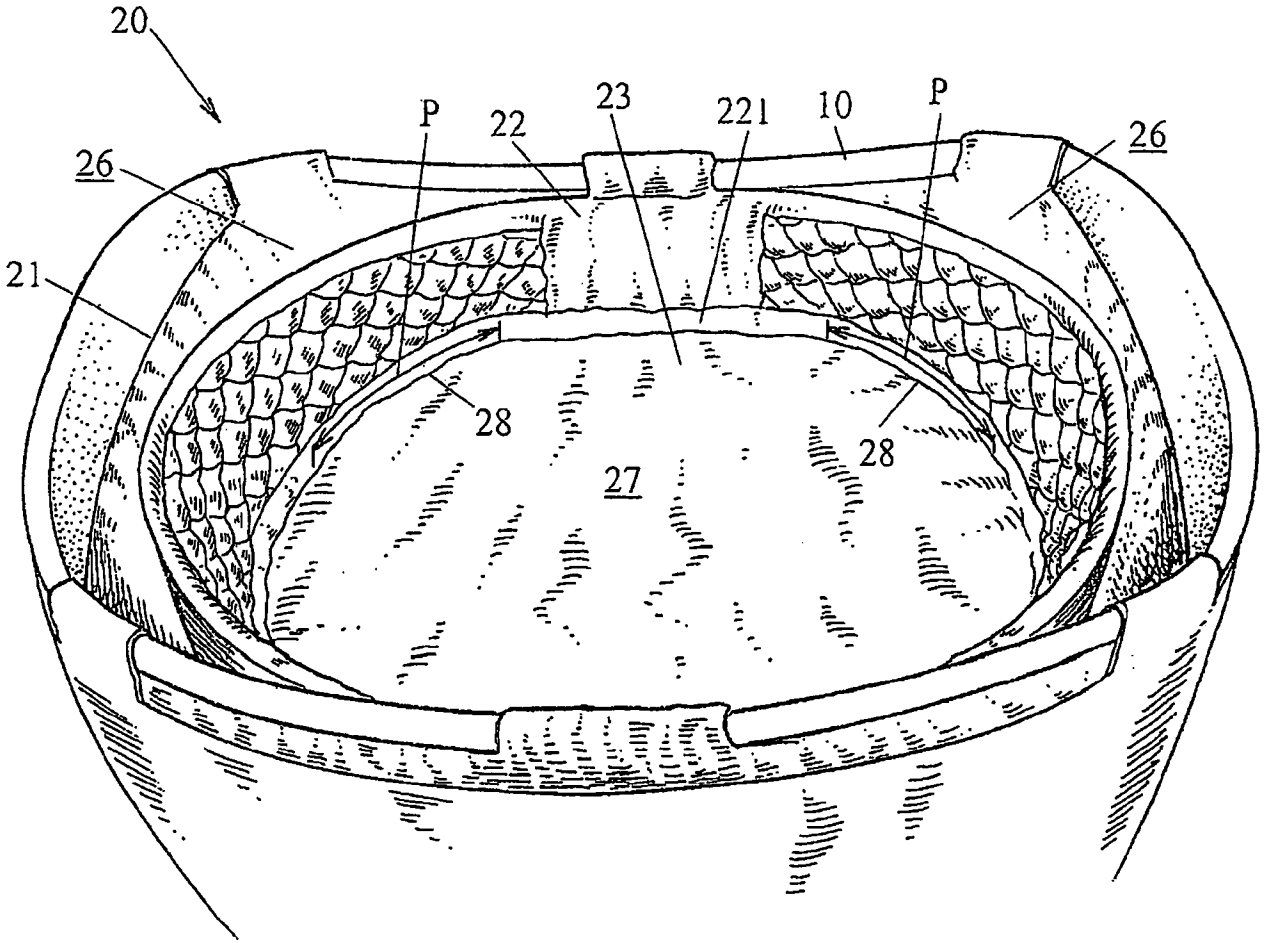
FIG. 1 is a perspective view of a cot according to an embodiment of the present invention.

A cot according to an embodiment of the present invention will be described below with reference to the drawings.

FIGS. 1 to 4 are perspective views sequentially showing the arrangements before and after a foldable bed pad 30 is laid in a cot 20. The cot shown in the drawings is a cot 20 having a containing space 29. The cot 20 can be suspended in a suitable frame assembly, for example, a frame assembly 10 for a playard.

Figure 4:
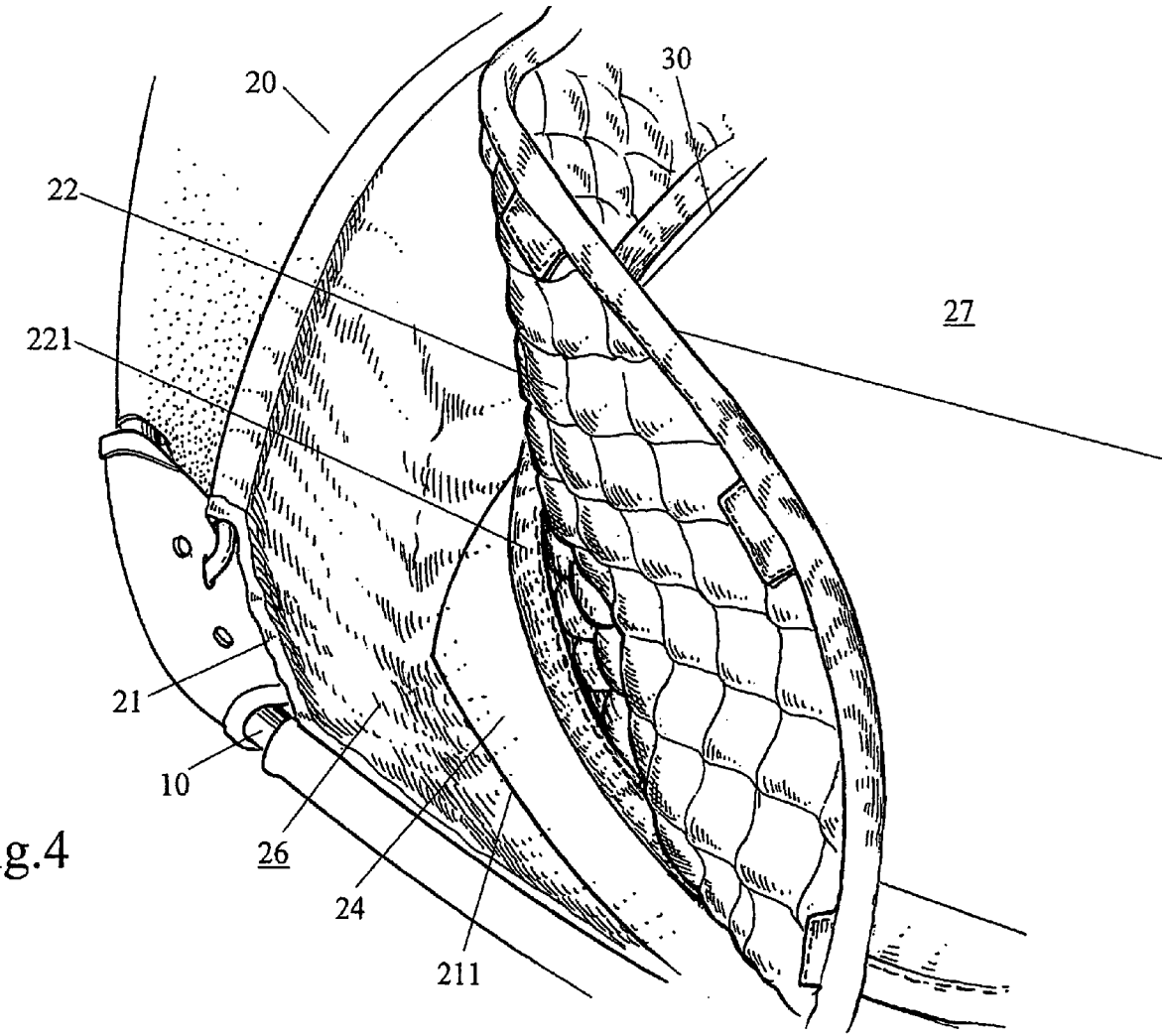
FIG. 4 is a perspective view showing a storage space in the cot of FIG. 3.
Figure 5:
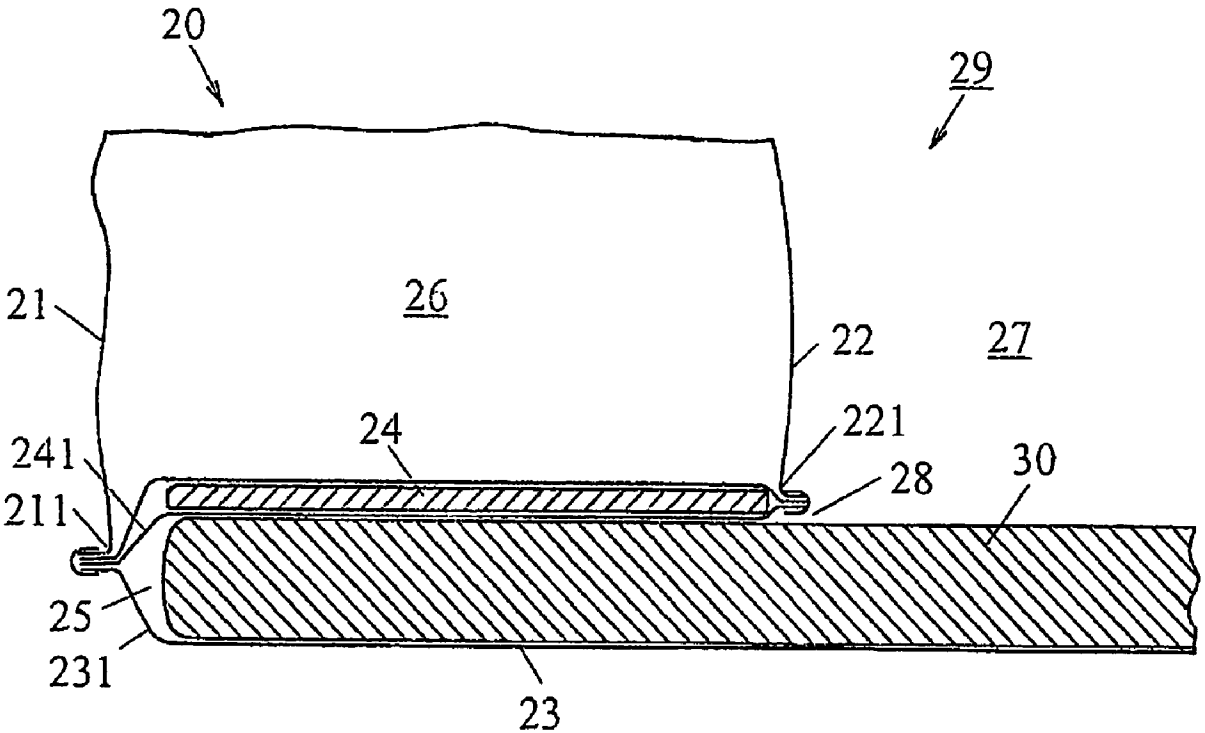
FIG. 5 is a cross-sectional view as taken along line A—A shown in FIG. 4.

The cot 20 comprises an outer member 21 having a substantially rectangular cross-section, an inner member 22, having a substantially oval cross-section a bottom member 23 in substantially rectangular shape, and four corner members 24 in substantially triangular shape. The outer, inner, bottom and corner members are made of fabric. The corner members 24 contain a hard material such as plastics therein. The members are linked together by sewing them, in which the lower peripheral edge 211 of the outer member 21 is connected to the bottom member 23, thereby forming a containing space 29. The corner members 24 are located at four corners of the bottom member 23. As shown in FIGS. 4 and 5, the inner member 22 is provided in the containing space 29 so that in each of four corners of the bottom member 23, the lower peripheral edge 211 of the outer member 21 and the lower peripheral edge 221 of the inner member 22 are connected to the corner members 24 by means of sewing, respectively. Thus, the containing space 29 is divided by the inner member 22 into an infant space 27 located between the inner member 22 and the bottom member 23, and a storage space 26 located between the outer member 21, the inner member 22 and the corner members 24.

Except portions P of the lower peripheral edge 221 of the inner member 22 (see FIG. 1) which are sewn on the corner members 24, the other portions of the lower peripheral edge 221 are sewn on the bottom member 23 so that two of three sides of each of the corner members 24 are sewn on the lower peripheral edge 211 of the outer member 21, and the other side thereof is sewn on the lower peripheral edge 221 of the inner member 22. Thereby, an opening 28 is formed inside the infant space at a portion of the lower peripheral edge 221 of the inner member 22 corresponding to each of four corners of the outer member 21, and a pocket 25 is formed between the lower surface 241 of the corner member 24 and the upper surface 231 of the bottom member 23 (see FIG. 5).

Figure 2:
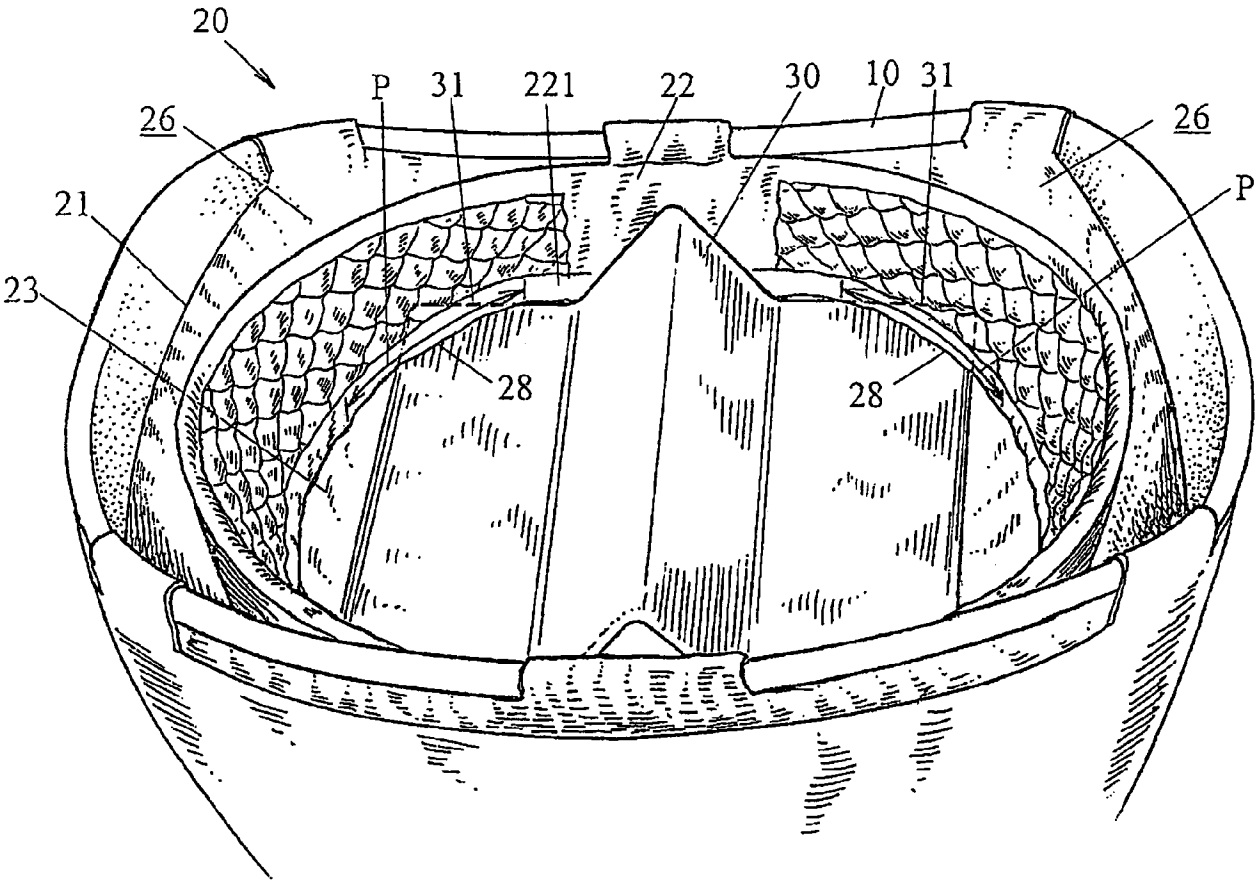
FIG. 2 is a perspective view of the cot of FIG. 1, showing the state in which a foldable bed pad is being laid in a cot.
Figure 3:
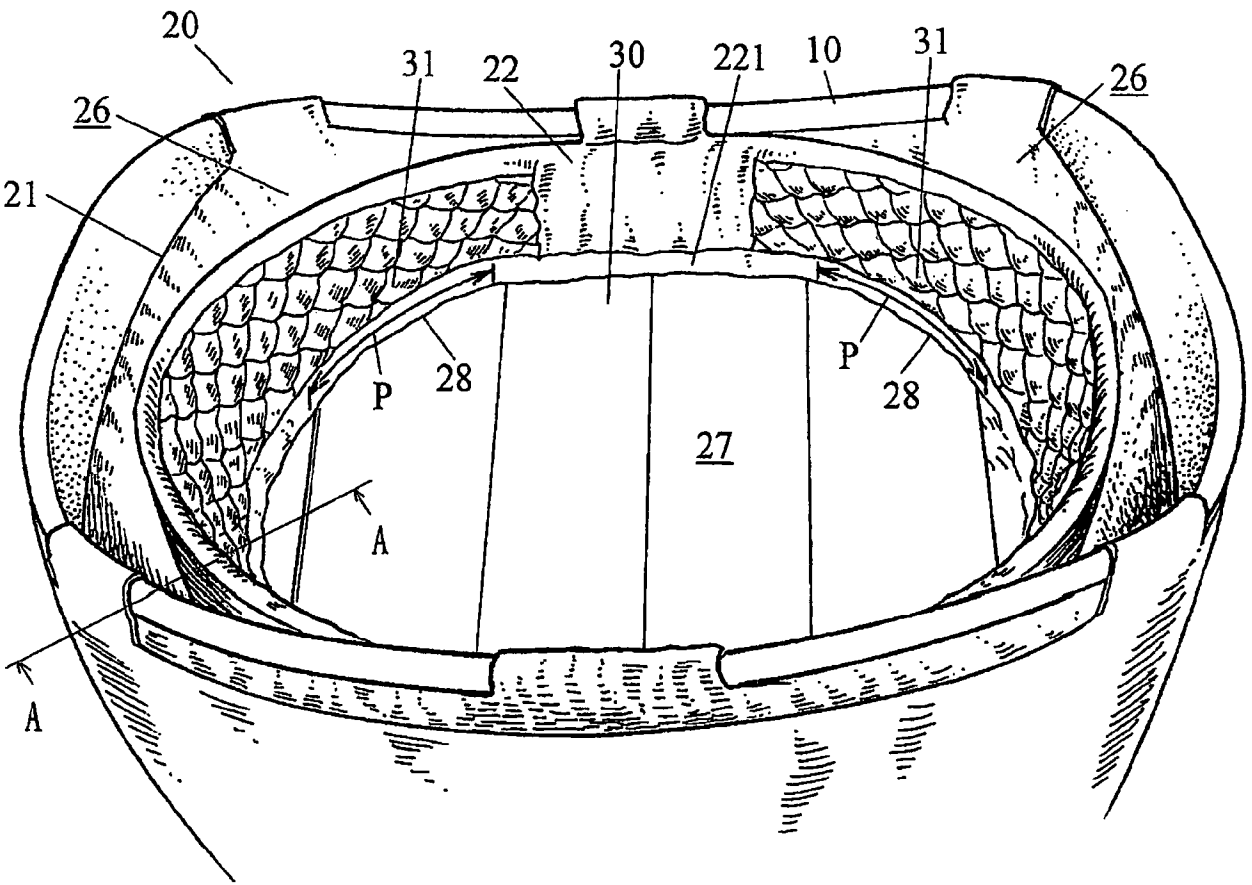
FIG. 3 is a perspective view of the cot of FIG. 2, showing the state in which the foldable bed pad is positioned in the cot.

As shown in FIGS. 2 and 3, the foldable bed pad 30 is laid on the bottom member 23 of the cot 20, and then each of four corners 31 of the bed pad 30 is inserted into the opening 28 and positioned in the pocket 25, thereby achieving the arrangement of the bed pad 30 in the cot 20. When removing the bed pad 30, each of the corners 31 of the bed pad 30 is pulled out of the pocket 25.

As the bed pad 30 is set in position, an infant can be placed in the infant space 27 to sleep. The bed bad 30 does not need to be sized in advance to fit in the infant space 27, and can be easily laid in the cot 20 without using Velcro, buttons or the like. Further, the corner members 24 contain a hard material therein so that the storage space 26 can be supported to store articles.

Alternatively, the lower peripheral edge 221 of the inner member 22 can be provided in a portion thereof corresponding to each of the corners of the outer members with an opening (not shown) for the corners of the bed pad 30 to pass therethrough. The lower peripheral edge 221 of the inner member 22 is unnecessarily sewn on one side of one of the corner member 24.

Further, the infant space 27 is unnecessarily of an oval shape, the lower peripheral edge 221 of the inner member 22 is unnecessarily sewn on one side of the corner members 24, and the corner members 24 unnecessarily contain a hard material therein.

Given the disclosure of the present invention, one skilled in the art would appreciate that there may be other embodiments and modifications within the scope and spirit of the present invention. Accordingly, all modifications attained by one skilled in the art from the present disclosure within the scope and spirit of the present invention are to be included as further embodiments of the present invention. The scope of the present invention accordingly is to be defined as set forth in the appended claims.

What is claimed is:

1. A cot (20) for receiving a bed pad (30) therein, comprising:

an outer member (21);

a bottom member (23) connected to the lower peripheral edge (211) of the outer member (21); and at least one corner member (24) connected to a corner of the bottom member (23);

wherein the outer member (21) and the bottom member (23) are configured as a containing space (29), and the corner member (24) and the bottom member (23) are configured as a pocket (25) for the bed pad (30) to be inserted and positioned therein.

2. A cot according to claim 1, further comprising an inner member (22) provided in the containing space (29), wherein the outer member (21), the inner member (22) and the corner member (24) are configured as a storage space (26).

3. A cot according to claim 2, wherein the inner member (22) has a substantially oval cross-section.

4. A cot according to claim 2, wherein the corner member (24) is substantially triangular and one side of the corner member (24) is connected to the lower peripheral edge (221) of the inner member (22).

5. A cot according to claim 2, wherein portions of the lower peripheral edge (221) of the inner member (22) corresponding to corners of the outer member (21) are formed with openings thereon for the corners of the bed pad (30) to pass therethrough.

6. A cot according to claim 2, wherein the outer member (21), the inner member (22), the bottom member (23) and the corner member (24) are made of fabric.

7. A cot according to claim 1 or 2, wherein the bed pad (30) is a foldable bed pad.

8. A cot according to claim 1 or 2, wherein the connection is by means of sewing.

9. A cot according to claim 1 or 2, wherein the corner member (24) contains a hard material therein.

10. A cot according to claim 9, wherein the hard material is a plastic material.

11. A cot according to claim 1 or 2, wherein the cot (20) is detachably suspended in a frame assembly (10) of a playard.

12. A cot according to claim 1, wherein the outer member (21) has a substantially rectangular cross-section.

13. A cot according to claim 1, wherein the bottom member (23) is substantially rectangular.

14. A detachable cot (20) for a playard, comprising:

an outer member (21);

an inner member (22);

a bottom member (23) connected to the lower peripheral edge (211) of the outer member (21);

at least one corner member (24) connected to a corner of the bottom member (23); and a foldable bed pad (30);

wherein the outer member (21) and the bottom member (22) are configured as a containing space (29), and the inner member (22) is provided in the containing space (29) and connected to the corner member (24) at the lower peripheral edge (221) of the inner member (22), and wherein the outer member (21), the inner member (22) and the corner member (24) are configured as a storage space (26), and the corner member (24) and the bottom member (23) are configured as a pocket (25) for the foldable bed pad (30) to be inserted and positioned therein.

* * * * *